United States Patent [19]

Kirchner

[11] Patent Number: 4,527,635

[45] Date of Patent: Jul. 9, 1985

[54] AUTOMATIC FIRE EXTINGUISHING APPARATUS

[76] Inventor: Richard N. Kirchner, 11204 Gasch Rd., Harvard, Ill. 60033

[21] Appl. No.: 440,587

[22] Filed: Nov. 10, 1982

[51] Int. Cl.[3] ..... A62C 35/02

[52] U.S. Cl. ..... 169/26; 169/42; 169/57

[58] Field of Search ..... 169/26, 42, 56, 57, 169/58, 60, 72

[56] References Cited

U.S. PATENT DOCUMENTS

| | | | |
|---|---|---|---|
| 2,081,325 | 5/1937 | Doughty | 169/26 |
| 2,166,277 | 7/1939 | Adams | 169/26 |
| 2,474,099 | 6/1949 | Doughty | 169/26 |
| 2,774,432 | 12/1956 | Danziger | 169/57 |
| 3,348,617 | 10/1967 | Macartney | 169/42 |
| 3,387,662 | 6/1968 | Molgano, Jr. | 169/26 |
| 3,392,787 | 7/1968 | Weise | 169/26 |
| 3,407,879 | 10/1968 | O'Rear | 169/9 |
| 3,446,286 | 5/1969 | Kreidler | 169/26 |
| 3,448,808 | 6/1969 | Scofield | 169/2 |
| 3,464,497 | 9/1969 | Globerman | 169/2 |
| 3,536,139 | 10/1970 | Berti et al. | 169/60 |
| 3,547,201 | 12/1970 | Balmes | 169/26 |
| 3,650,328 | 3/1972 | Fujiki et al. | 169/19 |
| 3,664,430 | 5/1972 | Sitabkhan | 169/23 |
| 3,719,231 | 3/1973 | Haggard | 169/56 |
| 3,800,878 | 4/1974 | Poitras | 169/57 |

FOREIGN PATENT DOCUMENTS

| | | | |
|---|---|---|---|
| 620178 | 4/1927 | France | 169/26 |
| 1556217 | 11/1979 | United Kingdom | 169/26 |

*Primary Examiner*—Jeffrey V. Nase

*Attorney, Agent, or Firm*—Hosier & Sufrin, Ltd.

[57] ABSTRACT

An automatic fire extinguishing apparatus with a heat fusible element comprising inner and outer members held together by a fusible material blocking the flow of fire extinguishing agent until the contiguous temperature reaches a pre-determined threshold value whereupon the inner and outer members separate to release the fire extinguishing agent. A fire extinguishing apparatus having both manual and automatic release mechanisms.

1 Claim, 6 Drawing Figures

AUTOMATIC FIRE EXTINGUISHING APPARATUS

BACKGROUND OF THE INVENTION

This invention relates generally to fire extinguishing apparatus, and, more particularly, to a fire extinguishing apparatus having heat-activated means for automatically releasing a fire extinguishing agent. In one important embodiment of the present invention, the apparatus comprises a pressurized tank containing fire extinguishing agent, and separate manual and automatic means for releasing the fire extinguishing agent.

Numerous techniques have been suggested for automatically activating fire extinguishing apparatus when the surrounding temperature surpasses a predetermined threshold value. For example, one broad grouping of prior art automatic fire extinguishing apparatus utilizes valves which open to release a fire extinguishing agent in response to temperature sensitive, spring loaded cams or pistons. Another group of prior art automatic fire extinguishing systems employs frangible seals which are designed to be either shattered or pierced by a separate, temperature sensitive mechanism. Finally, more recent contributions to the art utilize heat sensitive electronic sensing circuits which activate separate fire extinguishing apparatus valves. As a result of their complexity, many of these prior art devices are dangerously unreliable. Furthermore, in all of these cases, the equipment is not only complex, it is also unduly expensive and unwieldy.

SUMMARY OF THE INVENTION

Accordingly, it is one of the principal objects of this invention to provide an automatic fire extinguishing apparatus which is simple and compact in design, and which will operate in a reliable manner.

Yet another object of the present invention is to provide a fire extinguishing apparatus which may be operated both automatically and manually.

A further object of this invention is to provide means for automatically releasing fire extinguishing agent, which may be conveniently fitted to conventional fire extinguisher cylinders.

Further objects of the present invention will be apparent from the discussion below.

The present invention is directed to an automatic fire extinguishing apparatus including a source of pressurized, fire extinguishing agent and, a mechanism for automatically releasing the fire extinguishing agent. The automatic release mechanism includes a passage for the fire extinguishing agent and a closed heat fusible element extending across the passage for blocking the flow of the extinguishing agent. The closed heat fusible element is adapted to open when the temperature of the environment contiguous to the automatic release mechanism rises past a pre-determined threshold value, thereby permitting the fire extinguishing agent to cool or extinguish the local source of the rise in temperature, such as a fire within range of the apparatus.

The closed heat fusible element includes a flat, rigid inner member having an aperture and a flat rigid outer member large enough to cover the aperture. The inner and outer members are joined by a fusible material which melts at the threshold temperature, permitting the outer member to be forced away from the inner member by the pressurized fire extinguishing agent when the temperature of the contiguous environment exceeds the threshold temperature of the fusible material joining the inner and outer members. Thus, when the outer member is forced away from the inner member, the fire extinguishing agent will flow through the aperature and onto the local source of the temperature rise to cool or extinguish it.

In one important embodiment of the present invention, the automatic release mechanism is installed on a fire extinguisher cylinder which also carries a manual release mechanism. This permits the extinguisher to be mounted in one area for automatic protection of that area, while remaining available to be removed from its mounting and carried to another area for manually extinguishing a fire.

The automatic release mechanism of the present invention, with its closed heat fusible element directly blocking the flow of pressurized fire extinguishing agent, makes for an elegantly simple automatic fire extinguishing apparatus. This apparatus eliminates the shortcomings of the prior art since it is not only simple in design and operation, but also compact, inexpensive and extremely reliable in operation. In addition, the flexibility of application permitted by the optional combination of both manual and automatic release mechanisms fulfills a need not previously recognized or met in the art.

BRIEF DESCRIPTION OF THE DRAWINGS

The features of this invention which are believed to be novel are set forth with particularity in the appended claims. The invention, together with its objects and advantages, may be best understood by reference to the following description, taken in conjunction with the accompanying drawings, in which like reference numerals identify like elements in the several figures and in which:

DESCRIPTION OF THE PREFERRED EMBODIMENT

Figure 1:
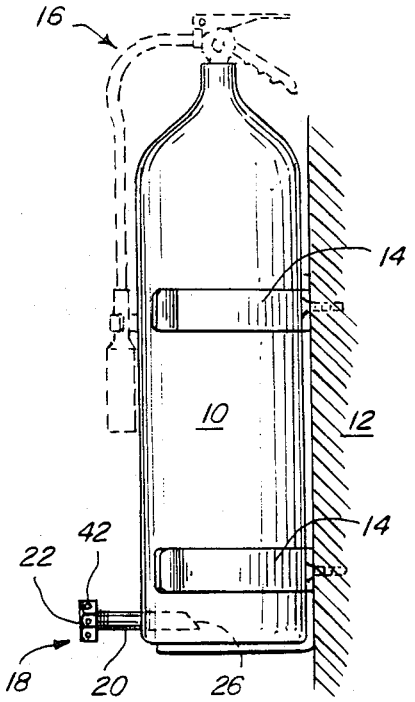
FIG. 1 is a side elevation view of a fire extinguisher apparatus having a conventional manual release mechanism as well as an automatic release mechanism in accordance with the teachings of the present invention.

Turning now to FIG. 1, a source of pressurized fire extinguishing agent, in the form of a portable pressurized fire extinguisher cylinder 10, is illustrated. Cylinder 10, which is shown mounted to a wall 12 by brackets 14, includes an optional, conventional manual release mechanism 16, as shown in phantom. The cylinder preferably contains a conventional dry fire extinguishing chemical backed by a propellant such as nitrogen, although it may contain any fluid extinguishing agent.

Figure 3:
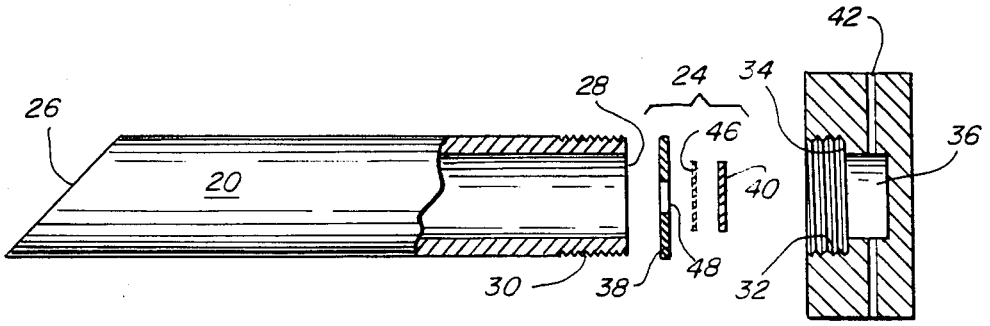
FIG. 3 is a partially sectioned, exploded assembly view of the automatic release mechanism of FIG. 2.
Figure 4:
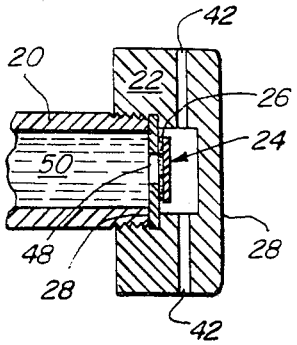
FIGS. 4A–4C are partial, sectioned views, broken away from the automatic release mechanism of FIG. 1, showing the automatic operation of the release mechanism as the contiguous temperature rises above the threshold valve.

Fire extinguisher cylinder 10 is fitted with an automatic release mechanism 18 including a rigid tube 20, a hexagonal sprinkler cap 22 and a closed heat fusible element 24 (FIGS. 3 & 4A).

Tube 20 has a beveled end 26 which extends into the fire extinguisher cylinder. The tube may be threaded, welded or otherwise attached to the cylinder in a fashion which will prevent leakage of the pressurized contents of the cylinder.

The distal end 28 of tube 20 is threaded at 30 to accept hexagonal sprinkler cap 22, as best seen in FIG. 3. Cap 22 has an internally threaded annular collar 32 of diameter corresponding to the diameter of the tube, and an inner annular shoulder 34. Thus, when closed heat fusible element 24 is positioned across the distal end 28 of tube 20, and the cap is screwed into place, the fusible element is clamped into place between the tube end and the inner shoulder of the cap, thereby blocking the escape of fire extinguishing agent through the tube.

Figure 2:
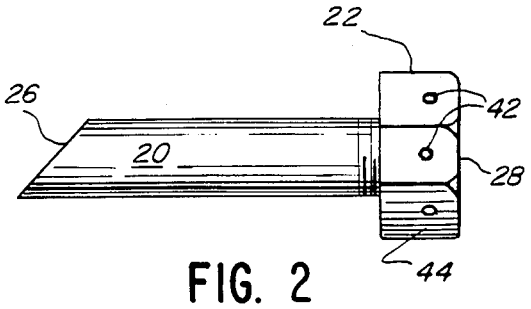
FIG. 2 is an enlarged side elevation view of the automatic release mechanism of the present invention.

Hexagonal cap 22 includes cavity 36 for receiving the outer disc 40 of the closed fusible element when it is forced away from the inner disc 38, as will be discussed in detail below. Hexagonal cap 22 also includes a series of sprinkler passage 42 in each of its circumferential faces 44 (FIG. 2), extending through to cavity 36. These holes are arranged about the cap to distribute the fire extinguishing agent in a broad, pre-determined spray pattern.

Closed heat fusible element 24 includes a rigid inner disc 38 joined in face-to-face fashion to a rigid outer disc 40 by a fusible material 46 at their interface which melts at a pre-determined threshold temperature. Material 46 may be solder, temperature sensitive adhesive, or any other material capable of firmly joining the inner and outer discs until the desired threshold temperature is reached at which the pressurized fire extinguishing agent is to be released.

Inner disc 38 includes a central aperture 48 through which the fire extinguishing agent will flow when the fusible element opens, as discussed below. Outer disc 40 is smaller than inner disc 38, although it must be large enough to cover aperture 48 with a sufficient annular overlap to permit the inner and outer discs to be securely sealed together by the fusible material. In addition, outer disc 40 must be small enough to permit clamping between annular shoulder 34 and tube distal end 28 at the inner disc only, so that the outer disc will be free to pull away from the inner disc when the threshold temperature is reached.

Figure 4B:
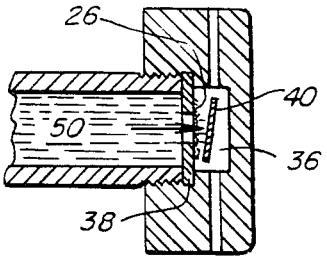
Figure 4C:
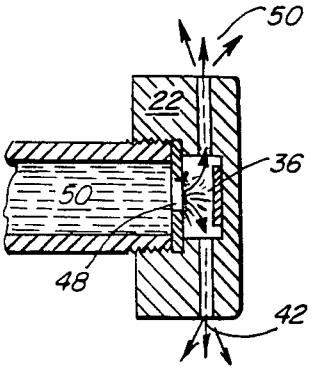

In a typical application, a fully assembled automatic release mechanism is fitted to the bottom of an empty cylinder, which may also include a conventional manual release mechanism, at its top. Once the automatic release mechanism is fixed in place, the cylinder is charged with pressurized fire extinguishing agent, sealed and mounted in an area which is intended to be protected from temperatures above a pre-determined threshold value, as illustrated in FIG. 1. The partial, sectional views of the automatic release mechanism of FIGS. 4A–4C illustrate the automatic operation of the apparatus.

Turning first to FIG. 4A, closed heat fusible element 24 is shown, held in place across distal end 28 of rigid tube 20. The surrounding temperature is below the threshold value. If, for example, a fire breaks out in the area intended to be protected, the automatic release mechanism will be heated until the threshold temperature is reached, whereupon fusible material 26 will melt and outer disc 40 will be forced away from inner disc 38 and into cavity 36 by the pressure of the pressurized fire extinguishing agent 50, as illustrated in FIG. 4B. When the outer disc is pushed out of the way, as illustrated in FIG. 4C, the fire extinguishing agent will flow freely through aperture 48 of the inner disc, into cavity 36 and out of the sprinkler passages 42 of hexagonal sprinkler cap 22 to extinguish the fire.

After the cylinder is exhausted, it may be reused. In order to do so, hexagonal sprinkler cap 22 is unscrewed, and discs 38 and 40 are removed and replaced by a new closed heat fusible element. The cap is then again screwed into place, and the fire extinguisher cylinder recharged to be at the ready for another automatic operation.

If cylinder 10 is fitted with optional conventional manual release mechanism 16, as illustrated in FIG. 1, its versatility is greatly enhanced. Thus, while the tank will be at the ready for automatic operation at the place in which it is mounted, should a fire break out in a remote area, it may simply be removed from brackets 14 and carried to that area for manually extinguishing the fire there. Furthermore, this novel concept of dual manual and automatic operation in a fire extinguishing apparatus is not limited to the automatic release mechanism 18 of the present invention, but may be used with any automatic release mechanism capable of being mounted to a fire extinguisher cylinder.

It should be understood that the present invention may be embodied in other specific forms, without departing from the spirit or central characteristics thereof. The present embodiments are to be considered as illustrative and not as being restrictive, and the invention is not to be limited to the details herein but may be modified within the scope of the appended claims.

What is claimed is:

1. An automatic fire extinguishing apparatus comprising:

a portable tank containing pressurized fire extinguishing agent;

means, mounted to said tank, for automatically releasing said fire extinguishing agent, said automatic release means including a tube extending from said tank, said automatic release means further including a closed heat fusible element extending across the distal end of said tube in direct contact with at least a portion of said fire extinguishing agent for blocking the flow of said fire extinguishing agent therethrough;

said closed heat fusible element including a flat, rigid inner disc having a central aperture and a flat rigid outer disc large enough to cover said aperture but smaller in diameter than said inner disc;

said inner and outer discs being held together in a sealing face-to-face fashion by a fusible material disposed at their interfacing surfaces which melts at said threshold temperature;

said automatic release means yet further including a sprinkler cap, attached to said distal end of said tube, for distributing said fire extinguishing agent in a pre-determined spray pattern;

said sprinkler cap including an annular shoulder for holding said closed heat fusible element in place across said distal end of said tube;

said sprinkler cap further including a cavity for receiving said fusible element outer disc when it is forced away from said fusible element inner disc;

whereby said outer disc will be forced away from said inner disc and into said cavity by the pressure of said fire extinguishing agent when the temperature of the contiguous environment exceeds said threshold temperature, permitting said fire extinguishing agent to flow through said aperture and out said sprinkler in said pre-determined spray pattern.

* * * * *